United States Patent [19]

Suzuki et al.

[11] Patent Number: 4,989,043

[45] Date of Patent: Jan. 29, 1991

[54] COLOR-BALANCE CONTROL METHOD

[75] Inventors: Koji Suzuki, Yokohama; Hajime Oyama, Ichikawa; Shinichi Namekata; Yuji Sawai, both of Yokohama; Hideo Yoo, Tama, all of Japan

[73] Assignee: Ricoh Company, Ltd., Tokyo, Japan

[21] Appl. No.: 347,209

[22] Filed: May 4, 1989

[30] Foreign Application Priority Data

May 9, 1988 [JP] Japan ..... 63-110570
May 9, 1988 [JP] Japan ..... 63-110571

[51] Int. Cl.[5] ..... G03G 21/00; G03G 15/01

[52] U.S. Cl. ..... 355/246; 355/208; 355/326; 355/327; 430/43

[58] Field of Search ..... 355/327, 214, 246, 208, 355/326, 205, 206, 207; 430/42-44, 97, 102, 117, 120

[56] References Cited

U.S. PATENT DOCUMENTS

| | | | |
|---|---|---|---|
| 3,872,825 | 3/1975 | Davidson | 355/246 X |
| 4,277,549 | 7/1981 | Tatsumi et al. | 355/246 X |
| 4,365,894 | 12/1982 | Nakamura | 355/246 X |
| 4,514,480 | 4/1985 | Wada et al. | 355/246 X |
| 4,519,695 | 5/1985 | Murai et al. | 355/246 |
| 4,572,654 | 2/1986 | Murai et al. | 355/214 |
| 4,607,933 | 8/1986 | Haneda et al. | 355/246 |
| 4,607,944 | 8/1986 | Rushing | 355/246 |
| 4,610,532 | 9/1986 | De Schamphelaere et al. | 355/246 |
| 4,829,336 | 5/1989 | Champion et al. | 355/214 X |
| 4,888,636 | 12/1989 | Abe | 355/326 X |
| 4,894,685 | 1/1990 | Shoji | 355/326 X |
| 4,903,051 | 2/1990 | Egawa et al. | 355/246 X |

FOREIGN PATENT DOCUMENTS

| | | |
|---|---|---|
| 55-162253 | 11/1980 | Japan . |
| 57-100448 | 6/1982 | Japan . |
| 57-163241 | 10/1982 | Japan . |
| 57-163242 | 10/1982 | Japan . |
| 58-217960 | 12/1983 | Japan . |
| 60-73655 | 4/1985 | Japan . |

OTHER PUBLICATIONS

IBM Technical Disclosure Bulletin, vol. 20, No. 4, Sep. 1977, pp. 1307-1308, Bothe, A. J., "Toner Concentration Sensing".

*Primary Examiner*—A. T. Grimley
*Assistant Examiner*—Matthew S. Smith
*Attorney, Agent, or Firm*—Oblon, Spivak, McClelland, Maier & Neustadt

[57] ABSTRACT

In a multicolor image-forming apparatus having a photoelectric sensor for detecting the amount of toner of an unfixed toner image adhering onto a photosensitive element, and a toner density sensor for detecting the density of a developer in a developing machine to form a multicolor image by overlapping the toner images having a plurality of colors, a color-balance control method comprises the steps of correcting a setting value of an output of the toner density sensor of the developing machine in accordance with the change in amount of toner adhering onto a photosensitive element detected by the photoelectric sensor with respect to a high density section; setting an allowable range of the toner density in advance in the developing machine with respect to the toner having at least one color; setting the amount of toner adhering onto a photosensitive element of the at least one color as a reference when the toner density is changed outside the allowable range; and correcting the amount of toner adhering onto a photosensitive element of the other color in accordance with the reference. With respect to a half-tone section, the output of the photoelectric sensor may be corrected by controlling the exposure amount. With respect to the high density section, the output of the toner density sensor may be corrected in a predetermined way when the toner density is changed.

3 Claims, 7 Drawing Sheets

COLOR-BALANCE CONTROL METHOD

BACKGROUND OF THE INVENTION

The present invention relates to a color-balance control method of a multicolor image-forming apparatus such as a copying machine for color electronic photograph, a printer, etc.

In the multicolor image-forming apparatus for forming a multicolor image, i.e., a full color image such as a copying machine for electronic photograph, a printer, etc., it is necessary to stabilize the balance of the image having three colors, yellow, magenta and cyan for example, and balance these colors. In the conventional image-stabilizing method, a potentiometer for measuring the surface potential of a photosensitive element is disposed and the surface potential is made constant in accordance with the necessity to stabilize the image. In another conventional image-stabilizing method, a toner is adhered to a surface of the photosensitive element or a section for detecting the developing ability by a developing machine, and a light is irradiated onto a toner layer, and the reflected light is detected and the toner density is controlled such that the developing ability becomes constant.

In such conventional methods, the stabilizations of an latent image of the photosensitive element and the developing ability are separately performed so that a shift in balance of the colors is caused in the formation of the multicolor image, thereby unbalancing the gray color.

Further, in the conventional methods, since both the surface potentiometer of the photosensitive element and a photoelectric detector are used, the entire apparatus is complicated and the cost thereof is thereby expensive. Further, since both the potentiometer and the photoelectric detector are arranged near the developing machine, the apparatus tends to be dirty and the error in operation tends to be often caused. In particular, the conventional method for controlling the image density by controlling the toner density by the detection of a photoelectric sensor sometimes causes a mechanical abnormality in which the toner is scattered and accumulated in the shape of a film and the sensor is operated in error, etc., and an image abnormality in which a base material for forming the image thereon is dirty and the trace of a carrier is left by the toner and the toner is adhered to the carrier, etc.

SUMMARY OF THE INVENTION

It is therefore an object of the present invention to provide a color-balance control method providing a preferable color balance irrespective of the change in environment and causing no mechanical abnormality, etc.

The object of the present invention can be achieved by a color-balance control method of a multicolor image-forming apparatus having a photoelectric sensor for detecting the amount of toner of an unfixed toner image adhering onto a photosensitive element, and a toner density sensor for detecting the density of a developer in a developing machine to form a multicolor image by overlapping the toner images having a plurality of colors, the control method comprising the steps of correcting a setting value of an output of the toner density sensor of the developing machine in accordance with the change in amount of toner adhering onto a photosensitive element detected by the photoelectric sensor with respect to a high density section; setting an allowable range of the toner density in advance in the developing machine with respect to the toner having at least one color; setting the amount of toner adhering onto a photosensitive element of the at least one color as a reference when the toner density is changed outside the allowable range; and correcting the amount of toner adhering onto a photosensitive element of the other color in accordance with the reference.

In another embodiment, the object of the present invention can be achieved by a color-balance control method of a multicolor image-forming apparatus having a photoelectric sensor for detecting the amount of toner of an unfixed toner image adhering onto a photosensitive element, and a toner density sensor for detecting the density of a developer in a developing machine to form a multicolor image by overlapping the toner images having a plurality of colors, the control method comprising the steps of controlling an exposure amount such that a detected value of the amount of toner adhering onto a photosensitive element by the photoelectric sensor with respect to a half-tone section is in conformity with a reference density of each color in the color-balance control in the half-tone section; setting the toner density of the developing machine to a reference value in the color-balance control in a high density section when the amount of toner adhering onto a photosensitive element with respect to the high density section is dispersed depending on the colors with respect to the reference value; and correcting the output of the toner density sensor of each color by the same amount as a corrected value of the output of the toner density sensor of the developing machine within an allowable range of the toner density in accordance with the detected value of the photoelectric sensor with respect to a reference color when the toner density of each color is changed from the reference value.

Further objects and advantages of the present invention will be apparent from the following description of the preferred embodiments of the present invention as illustrated in the accompanying drawings.

DESCRIPTION OF THE PREFERRED EMBODIMENTS

Preferred embodiments of a color-balance control method of a multicolor image-forming apparatus in accordance with the present invention will now be described in detail with reference to the accompanying drawings.

Figure 1:
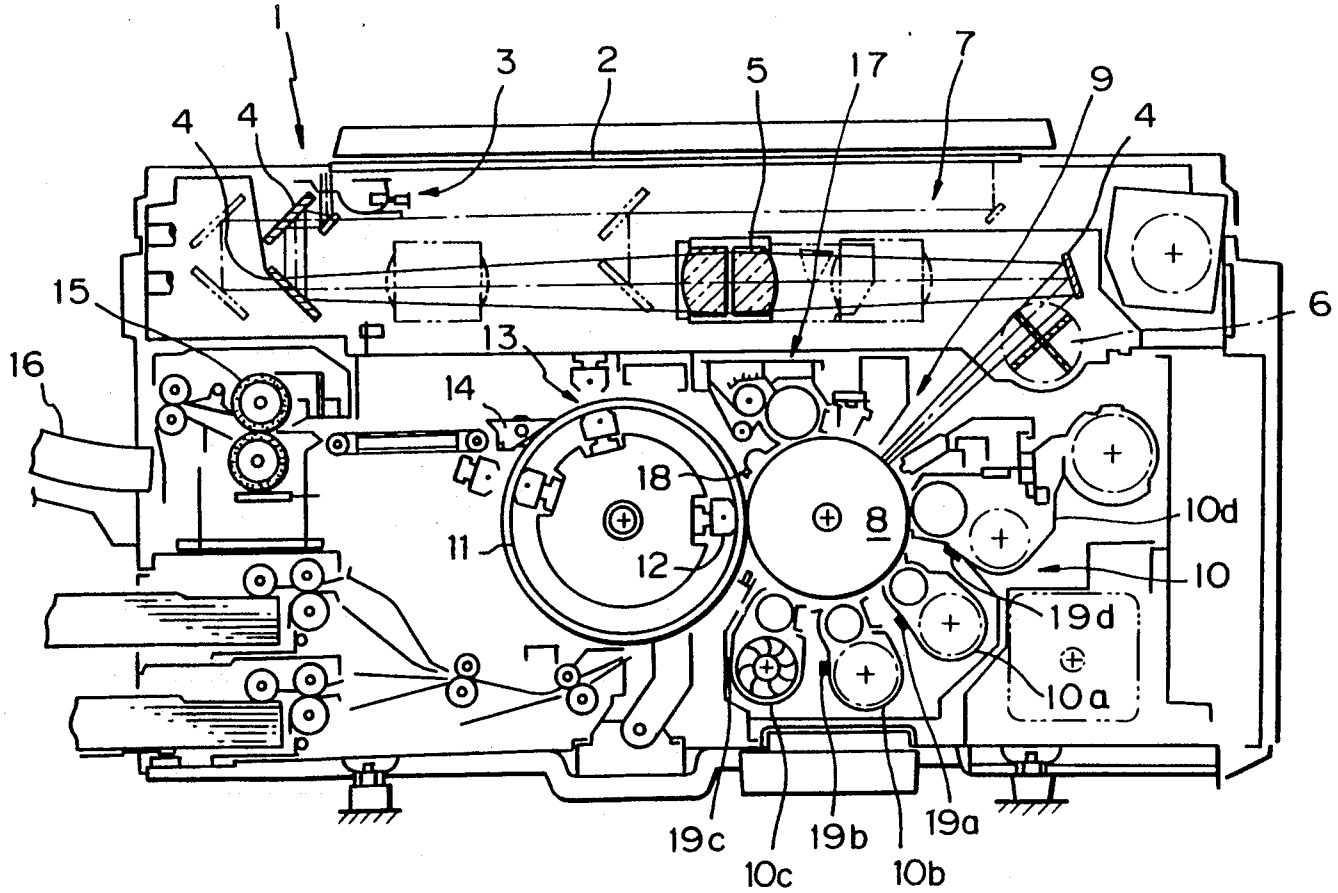
FIG. 1 is a schematic view for explaining a copying machine for color electronic photograph.

In an electronic multicolor copying machine 1 shown in FIG. 1 as an example of a multicolor image-forming apparatus, an original document on contact glass 2 is irradiated by lighting device 3 and the reflected light from the manuscript is projected onto photosensitive element 8 as an image decomposed with respect to the color by optical device 7 having mirror 4, lens 5 and filter 6 for decomposing the color.

Photosensitive element 8 is charged by charge-discharging device 9 for performing the charging and discharging operations. The image decomposed with respect to the color is focused by optical device 7 and an electrostatic latent image is thereby formed and developed by developing machine 10. The toner image is transferred onto a transfer paper wound around transfer drum 11 by the action of transfer charger 12. For example, the light image having a blue component by a blue filter for decomposing the color is projected onto photosensitive element 8 and its latent image is developed and appears by a developer of yellow developing section 10*a* a for a yellow color as a complementary color of the blue color. After the transfer of the yellow toner image, the latent image of the color-decomposed light image by a green filter is formed on photosensitive element 8 and is developed and appears by a developer of magenta developing section 10*b*. Thus, the magenta toner image is transferred on the yellow toner image in a state in which these images overlap each other. Further, a latent image of the color-decomposed light image by a red filter is formed and developed and appears by a developer of cyan developing section 10*c*. This developed image is transferred on the transfer paper in a state in which the above images overlap each other. In accordance with the necessity an image developed by a black toner in black developing section 10*d* is transferred on the transfer paper in the overlapping state.

The toner images overlap each other and are transferred on the transfer paper by three or four rotations of transfer drum 11.

After the transfer, the transfer paper is separated by transfer drum 11 by the actions of separating charger 13 and separating claw 14, and is fixed by fixing device 15 and is discharged to paper-discharging tray 16.

After the transfer operation, photosensitive element 8 is cleaned by cleaning device 17 and is charged and discharged by charge-discharging device 9 and thereby the image-forming processes mentioned above are repeatedly performed.

If necessary, an editor can be disposed on the contact glass to perform a partial copy by designating a certain region, a copy for converting the colors, a copy for synthesizing the black and other colors, a copy for synthesizing the original document and other documents, etc.

In the multicolor image formation, an important subject is that there is a balance of the color-decomposed images and the balance of three images of yellow, magenta and cyan for example is stabilized and there is a color balance of gray balance of the multicolor image or full color image.

Figure 2:
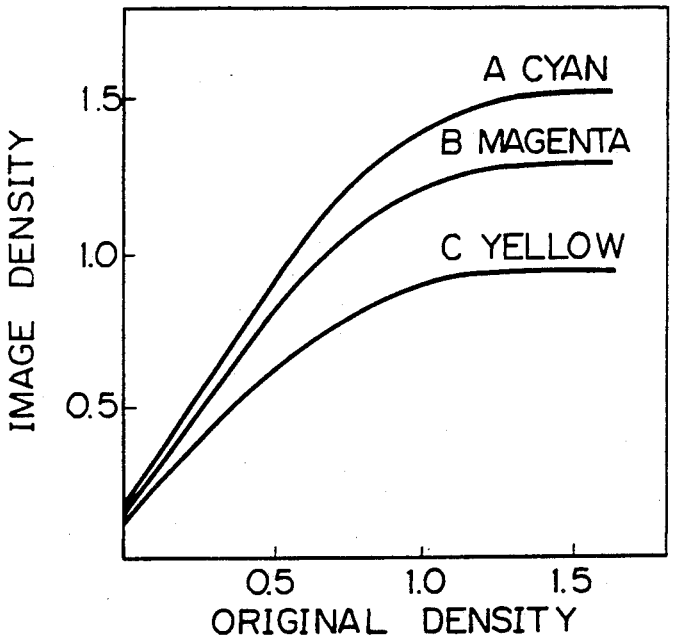
FIG. 2 is a graph showing an optimal density characteristic curve.

As shown in FIG. 2, when the multicolor image is formed by the respective images of three colors, yellow, magenta and cyan, it is preferable that the density ratios of the respective colors are selected.

In FIG. 2, the axis of abscissa shows the density of the original document and the axis of ordinate shows the density of the image. Curves A, B and C are optimal image density curves with respect to cyan, magenta and yellow, respectively.

Figure 3:
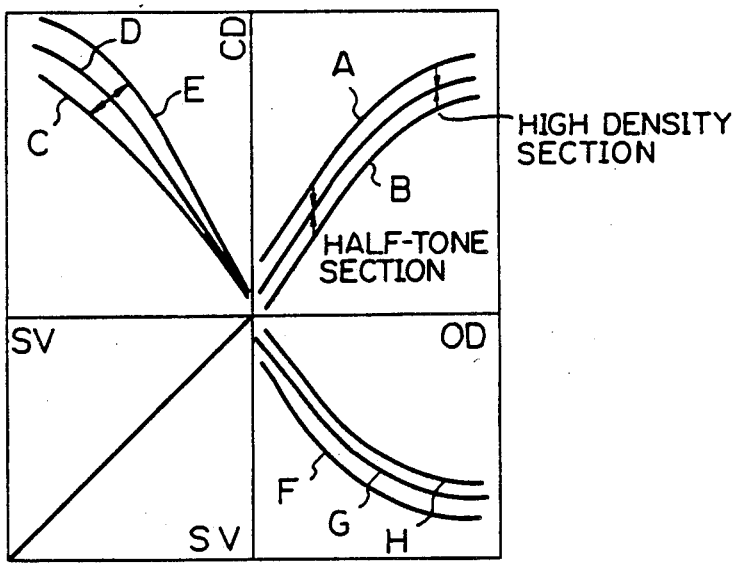
FIG. 3 is four charts for forming an image.

FIG. 3 shows four charts of the images formed by the toner having arbitrary colors. A first or right upper quadrant of this figure shows the relation between original density OD(axis of abscissa) and copy density CD(axis of ordinate). In the first quadrant, the copy density is varied by the ability with respect to the original document and the change in potential of the photosensitive element between curves A and B from a high density section to a low density section. As a result, the copy density is varied at any time so that the entire image becomes thick or thin when the respective colors, yellow, magenta and cyan are changed at the same density ratio. When there is an unbalance with respect to the respective colors, the color tone of the entire image is changed so that the copy quality is greatly deteriorated in the case of the multicolor image.

A second or left upper quadrant of FIG. 3 shows the relation between copy density(axis of ordinate) and potential SV of the photosensitive element(axis of abscissa). In this quadrant, curves C, D and E respectively show the changes in developing ability. A fourth or right lower quadrant of FIG. 3 shows the relation between potential SV of the photosensitive element(axis of ordinate) and original document density OD (axis of abscissa), and curves F, G and H respectively show the changes in potential of the photosensitive element.

Figure 4:
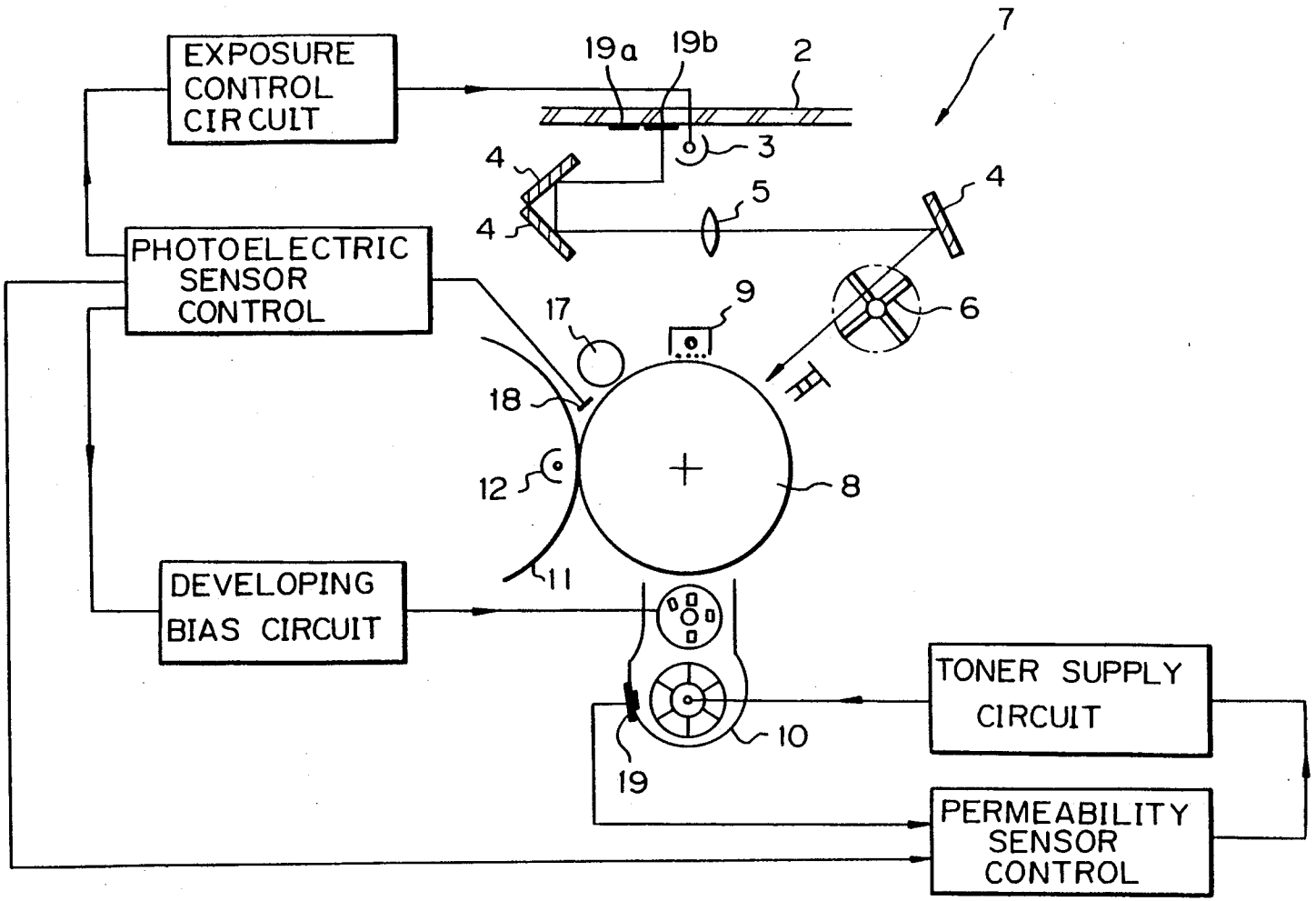
FIG. 4 is a block diagram showing a control system of the copying machine of FIG. 1.

As shown in FIG. 4, standard patterns such as pattern 19*a* for half-tone section and pattern 19*b* for high density section for example are provided in a position of the contact glass outside an image region thereof and are irradiated by lighting device 3. A pattern image is formed on photosensitive element 8 by optical device 7 in an exposure condition in which the lighting device is really used. This pattern image is developed as a toner image by developing machine 10. The density of the toner image is detected by photoelectric sensor 18 arranged under the transfer position in a state in which the toner image is not fixed, thereby outputting a voltage in accordance with the toner density.

Figure 5:
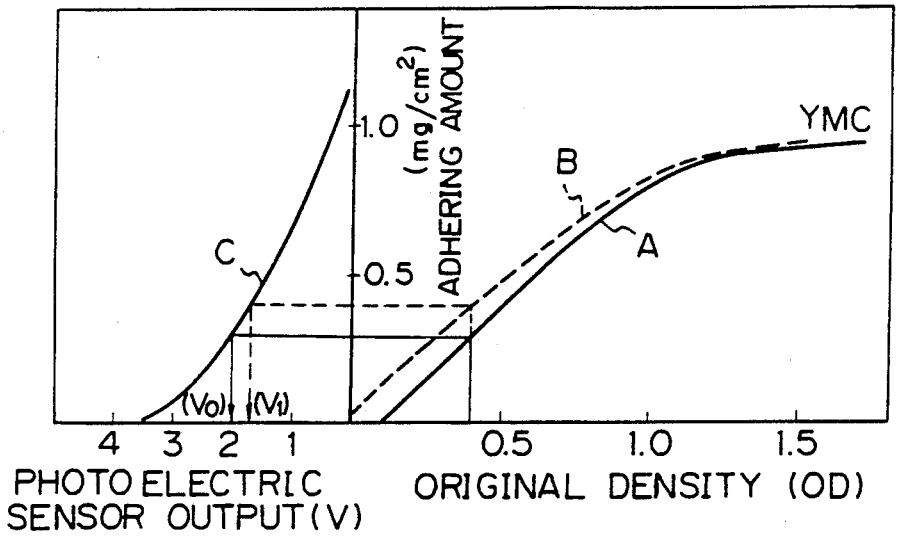
FIGS. 5 and 6 are graphs of characteristic curves showing the relation between an original density and an output of a photoelectric sensor in which FIG. 5 relates to a half-tone section and FIG. 6 relates to a high density section.

With respect to the pattern for half-tone section, for example, FIG. 5 shows the relation between original density OD(axis of abscissa) and the amount of toner adhering shown by unit $mg/cm^2$(axis of ordinate), and the relation between the amount of toner adhering (axis of ordinate) and output V of the photoelectric sensor (axis of abscissa). Curves A and B are characteristic curves showing the relation between the original density and the amount of toner adhering, respectively. Curve C is a characteristic curve showing the relation between the amount of toner adhering and the output of the photoelectric sensor. With respect to these characteristic curves, there is almost no difference in colors, yellow, magenta and cyan and therefore these curves are approximately same so that the description about the three colors can be made by a single curve.

Figure 6:
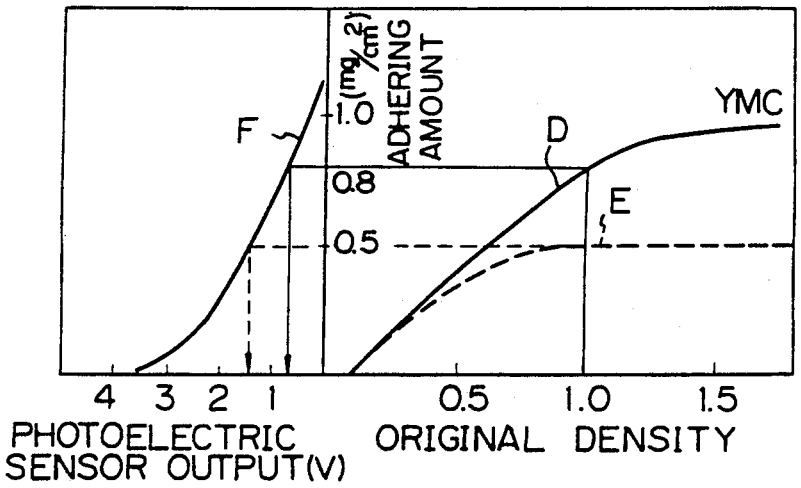

Similar to FIG. 5, FIG. 6 shows the relation between the amount of toner adhering and the original density, and the relation between the amount of toner adhering and the output of the photoelectric sensor with respect to the pattern for high density section.

The change in amount of toner adhering with respect to the original density, i.e., the change in image density is caused when the photosensitive element is deteriorated by fatigue thereof, etc.

For example, output $V_0$ of the photoelectric sensor with respect to pattern density 0.4 for half-tone section is 2 V as shown by curve A, but is changed by fluctuation to output $V_1$ thereof which is 1.7 V as shown by curve B.

Accordingly, when there is the change in density, the exposure amount is controlled by a control circuit for controlling the exposure in FIG. 4 such that the output of the photoelectric sensor is changed to predetermined voltage 2.0 V from 1.7V, thereby correcting curve B to curve A. In accordance with the necessity, the developing condition of the developing machine is corrected. This correction is preformed with respect to the respective colors, yellow, magenta and cyan. Thus, the density of the color balance can be constantly controlled with respect to the half-tone section.

Figure 7:
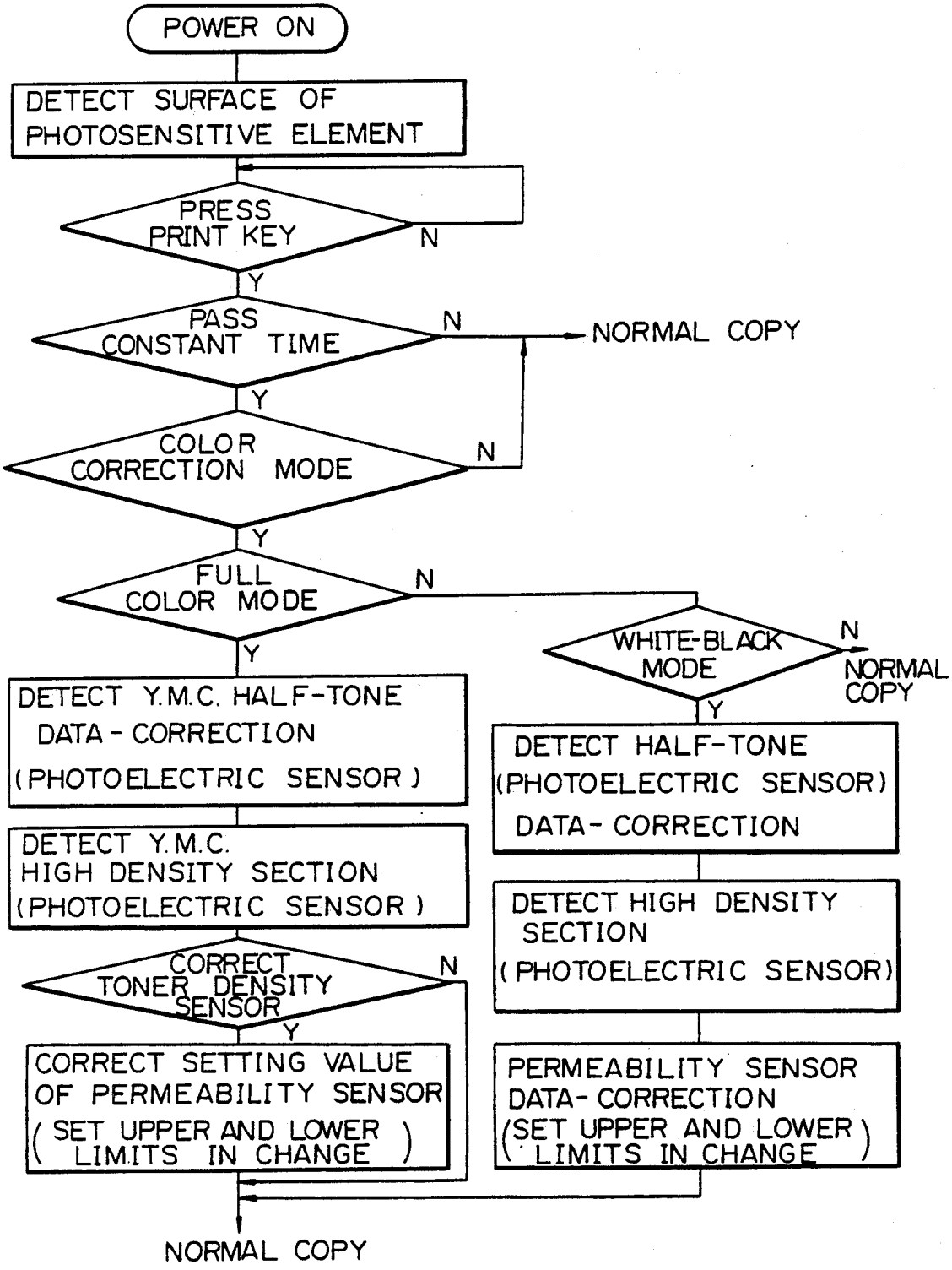
FIG. 7 is a control flow chart in accordance with a color-balance control method of the present invention.

In the high density section, the changes in characteristic of the color developers of yellow, magenta and cyan are different from each other by the aging and the change in environment. In the case of the full colors, when the charge amount is changed, the respective colors are changed unless the colors are changed in a similar way. in FIG. 6, when the characteristic curve in a certain color is changed from curve D to curve E, the output of the photoelectric sensor is changed from $V_0=0.7$ V to $V_1=1.5$ V in the case where the original density is 1.0. Similar to the case of the half-tone section, it is possible to control the exposure amount such that the output of the photoelectric sensor is corrected from voltage 1.5 V to 0.7 . However, in this case, the respective colors are not changed in the same way so that the color balance cannot be constantly held in the control of the exposure amount. Therefore, toner density sensors(e.g., sensors for detecting a magnetic permeability) 19*a*, 19*b*, 19*c* and 19*d* are respectively disposed to control the supply of the toner in developing sections 10*a*, 10*b*, 10*c* and 10*d* of the respective colors in developing machine 10, and setting values of the toner density in these toner density sensors are changed and corrected in accordance with the output from photoelectric sensor 18. A control flow chart in the correction of toner density sensors 19*a* to 19*d* is shown in FIG. 7.

Figure 8:
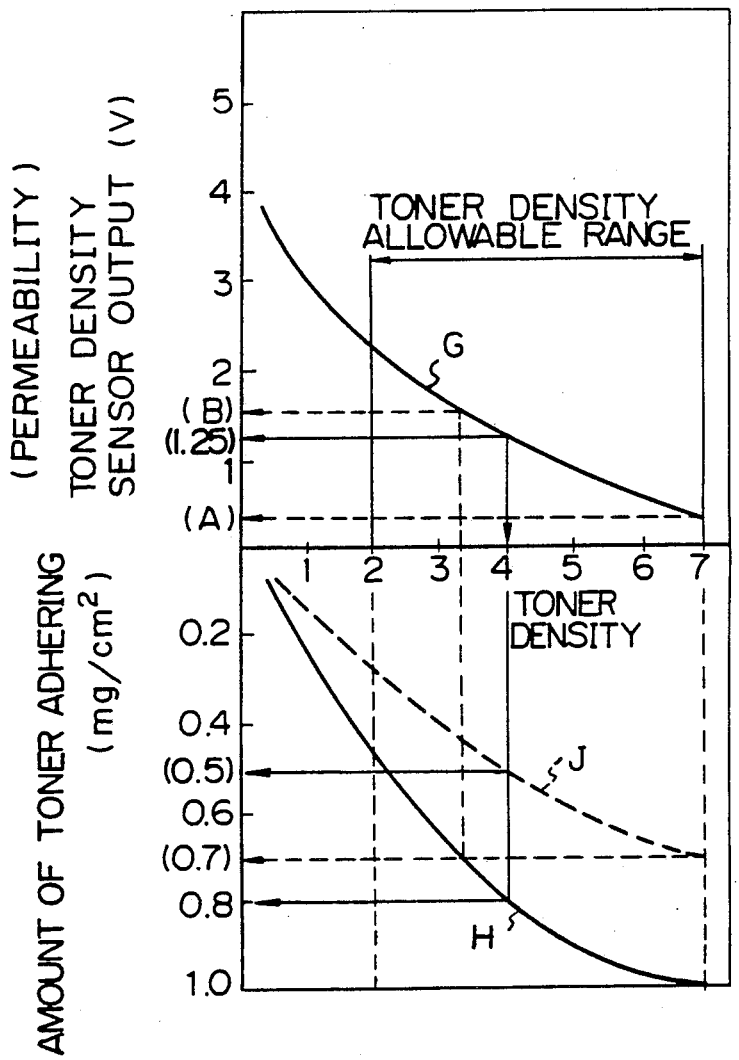
FIG. 8 is a view showing the relation between the adhering amount of the toner and an output of a sensor for detecting the toner density.

FIG. 8 shows the relation between the toner density(axis of abscissa) and the amount of toner adhering having unit mg/cm$^2$ (shown by the lower portion of the axis of ordinate), and the relation between the toner density and output V of the magnetic permeability or toner density sensor(shown by the upper portion of the axis of ordinate). By these relations of FIG. 8, the amount of toner adhering is detected by the photoelectric sensor and the output of the toner density sensor is thereby controlled so that the amount of toner adhering can be corrected. Namely, the relation between the toner density of the developing machine and the output of the toner density sensor is shown by curve G. The relation between the toner density and the amount of toner adhering is shown by curve H. The toner density has an allowable range determined in consideration of the toner scattering, etc., in the developing machine, and the toner is supplied to the developing machine such that the toner density is set within this allowable range.

As shown in FIG. 6, when the amount of toner adhering is predetermined value 0.8 mg/cm$^2$ with respect to original density 1.0, the output of the toner density sensor corresponding to this amount of toner adhering is about 1.25 V as shown in FIG. 8 . However, when the characteristic of the amount of toner adhering is changed to the characteristic shown by curve J of FIG. 8, at the value 4 of toner density, the photoelectric sensor output is 1.25 V for the value 1.0 of the original density, and the amount of toner adhering onto a photosensitive element is only 0.5 mg/cm$^2$. If the value 0.8 mg/cm$^2$ of the amount of toner adhering is desirable, the value of toner density must exceed more than 7, since the value of the amount of toner adhering is 0.7 mg/cm$^2$ at the value 7 of toner density in FIG. 8.

However, the value 7 of toner density is the upper limit of the allowable range, thereby it is not possible to increase the value of the amount of toner adhering more than 0.7 mg/cm$^2$ in this case.

Curve J of FIG. 8 shows the relation between the amount of toner adhering and the toner density with respect to one of the respective colors, yellow, magenta and cyan. With respect to the remaining two of the three colors, the amount of toner adhering is unbalanced by the colors when the target adhering amount is provided within the allowable range of the toner density. To solve this unbalance, when the amount of toner adhering of yellow, magenta and cyan is changed with respect to more than one color so that the toner density exceeds the allowable range and is corrected, the toner density is corrected to perform the color balance with, as a reference, the color most greatly shifted within the allowable range of the toner density. For example, when the yellow toner adhering amount is changed in accordance with curve J and the adhering amounts of the magenta and cyan toners are not changed and move along curve H, the setting value of the toner density sensor is corrected such that the toner density of the developing machine is increased by a signal showing that the toner density by the output of the photoelectric sensor is low with respect to the yellow image. However, even when the toner density has reached the allowable value 7%, the toner density is not increased to a value greater than 0.7 mg/cm$^2$. For example, when the adhering amounts of the yellow, magenta and cyan toners are the same and the coloring degrees of these toners have a color balance, the toner density is corrected to about 3.3 wt% by curve H such that the amount of toner adhering becomes 0.7 mg/cm$^2$ in the developing machines of the magenta and cyan. Therefore, the output of the toner density sensor(magnetic permeability sensor) of FIG. 8 is corrected and set to value B such as 1.5V for example. In this case, the output of the magnetic permeability sensor of the yellow developing machine is corrected and set to value A such as 0.3 V for example. When the toner has a coloring degree color-balanced at the ratios of the adhering amounts of the respective colors different from each other, the correction value may be changed in accordance with these ratios and the above-mentioned method can be applied even in this case.

Similar to the above case in which the density of one of the above-mentioned colors becomes thin, the output of the magnetic permeablilty sensor can be corrected even when the density of one of the colors becomes thick. In this case, the toner density of the most thick color is set to the lower limit value in the allowable range of the toner density.

As mentioned above, the color balance in the high density section can be constantly held in conformity with a reference adhering amount, i.e., the image density or the output of the photoelectric sensor at any time. However, when the adhering amount cannot be fixed to the reference adhering amount by the toner characteristics or the charged amount, the dispersion of the toner density caused by the dispersion of the sensor characteristics, the change in potential of the photosensitive element, etc., the toner density is used in a range which does not cause abnormal phenomena in which the toner is scattered and is formed in the shape of a film and a toner stripe is formed by the carrier at the low density time and the toner is adhered to the carrier. Thus, when one of the respective colors is excessively then, the color balance is performed with the wholly thin color as a reference. When one of the respective colors is excessively thick, the color balance is performed with the wholly thick color as a reference. Thus, the color image can be provided in the most preferable condition with respect to the image and the machine.

As mentioned above, in accordance with the present invention, it is possible to prevent a mechanical abnormality in which the toner is scattered and formed in the shape of a film and the sensor is operated in error, and an image abnormality in which the base material for forming the image thereon is dirty and the trace of the carrier is formed by the toner and the toner is adhered to the carrier. Such effects cannot be obtained by only the control of the toner density by the photoelectric sensor.

In accordance with the present invention, it is possible to stabilize the color balance under all the operating conditions of the apparatus.

Figure 9:
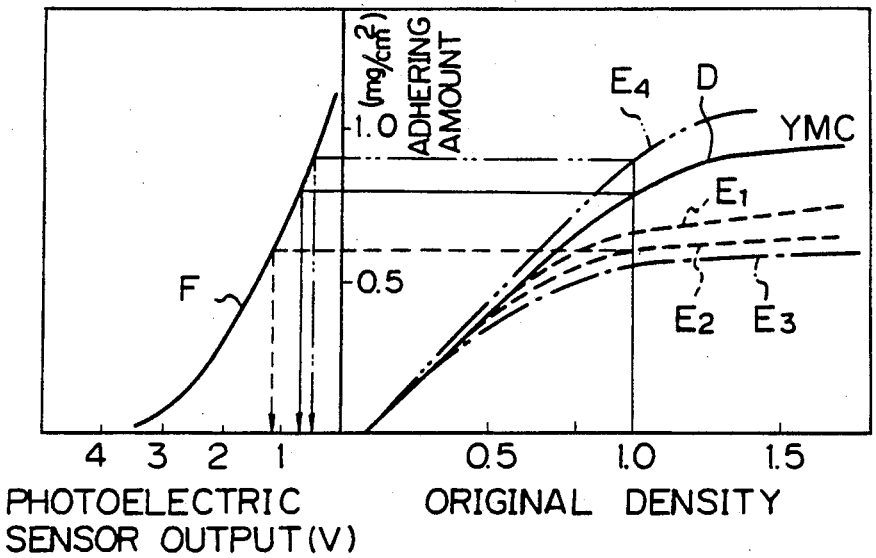
FIG. 9 is a graph of characteristic curves corresponding to FIG. 6 and showing the relation between the original density and the output of the photoelectric sensor with respect to the high density section.
Figure 10:
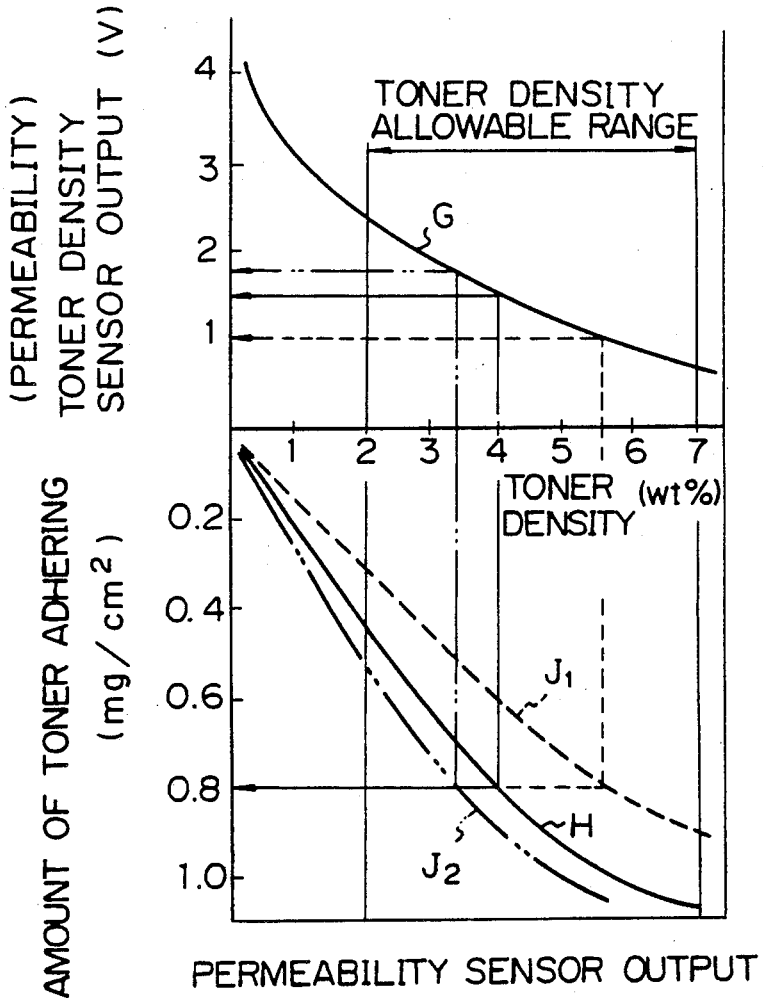
FIG. 10 is a view corresponding to FIG. 8 and showing the relation between the amount of adhering of the toner and the output of the sensor for detecting the toner density.

FIGS. 9 and 10 shows another embodiment of the present invention. FIG. 9 shows characteristic curves corresponding to FIG. 6. FIG. 10 shows characteristic curves corresponding to FIG. 8.

In this another embodiment, in the gray balance control in the half-tone section, similar to the embodiment shown in FIG. 5, curves A and B are provided and the output of the photoelectric sensor is changed from voltage 2 V to 1.7 V.

In FIG. 9, the reference characteristics with respect to the respective colors are shown by curve D. For example, when the density is lowered by the change in environment, etc., the yellow characteristic is changed and shown by curve $E_1$, the cyan characteristic is changed and shown by curve $E_2$, and the magenta characteristic is changed and shown by curve $E_3$. Curve $E_4$ shows the cyan characteristic when the density is increased. The characteristics of the other colors are omitted. As shown by curves $E_1$, $E_2$ and $E_3$, the density is shifted in the same density-decreasing direction with respect to the respective colors, yellow, magenta and cyan, and the shifted amount is often located within the allowable range to a certain extent. In this case, the central curve with respect to three curves of color characteristics is used. Namely, the output of the photoelectric sensor shown by the central curve is selected and used for a reference of the combination of the three colors to correct the toner density by the same toner amount within the allowable range thereof in the developing machine with respect to the three colors. In FIG. 9, characteristic curve $E_2$ is selected when the entire density is lowered. In the case of original density 1.0, the output of the photoelectric sensor is $V_0=0.7$ V in the case of reference characteristic curve D, but is changed to $V_1$=about 1.2 V in the case of characteristic curve $E_2$. When the density is increased, in the case of curve $E_4$, the output of the photoelectric sensor is changed to $V_2$=about 0.5 V in the case of original density 1.0.

With respect to the black balance in the high density section, when the density is lowered, similar to the case of the half-tone section in the first embodiment, it is possible to control the exposure amount such that the output of the photoelectric sensor is corrected from voltage 1.2 V to 0.7 V.

As shown in FIG. 9, when the amount of toner adhering is predetermined value 0.8 mg/cm$^2$ with respect to original density 1.0, the output voltage of the toner density sensor corresponding to this amount of toner adhering is about 1.5 V as in FIG. 10. However, when amount of toner adhering is lowered to e.g., value 0.6 mg/cm$^2$ lower than the target value, the characteristic is changed to that shown by curve $J_1$ of FIG. 10 for example and the output voltage of the toner density sendor is 1 V. In this case, when the toner density of the developing machine is changed to value 5.6% from reference value 4%, the toner adhering amount of the image pattern becomes 0.8 mg/cm$^2$, thereby holding the predetermined density. Then, the output of the toner density sensor is corrected and set from reference voltage 1.5 V to voltage 1 V such that the toner density of the developing machine is corrected from value 4% to 5.6%. A similar correction is performed with respect to yellow and magenta. Thus, the colors are sufficiently reproduced. Such a correction is easily performed in comparison with the correction performed by comparing all the yellow, magenta and cyan colors with the references, and the error in operation is reduced. In general, it is possible to perform the correction at a practical level from the toner characteristics by the above-mentioned method.

When the amount of toner adhering is increased to value 0.9 mg/cm$^2$ for example from the target value, the characteristic is changed to that shown by curve $J_2$ of FIG. 10 and the output voltage of the toner density sensor is 1.8 V. Accordingly, the output of the toner density sensor is corrected and set from reference voltage 1.5 V to voltage 1.8 V. At this time, the toner density of the developing machine becomes 3.4% and the amount of toner adhering is 0.8 mg/cm$^2$ which is similar to the previous adhering amount. A similar correction is performed with respect to yellow and magenta.

The characteristics of the color developers are not the same with respect to the respective colors. However, the change in characteristic of the above-mentioned typical one of the colors is detected and the correction is performed by the same adhering amount with respect to the respective colors, yellow, magenta and cyan, thereby providing a stable image having no practical problems and a black color balance.

When the densities of the respective colors are dispersed upwards or downwards with respect to the above-mentioned reference characteristics, the output of the toner density sensor is set to the reference value.

Even in the another embodiment shown by FIGS. 9 and 10, the effects of the present invention can be obtained.

Many widely different embodiments of the present invention may be constructed without departing from the spirit and scope of the present invention. It should be understood that the present invention is not limited to the specific embodiments described in the specification, except as defined in the appended claims.

What is claimed is:

1. A color-balance control method for use in an image forming system which forms a full color image by overlapping images composed of three colors of Yellow, Magenta and Cyan by means of an electrophotographic method, comprising the steps of:

controlling an amount of a toner supplied in response to each of a plurality of outputs of toner density sensors within an entire developing means;

forming an unfixed toner image for each of the three colors onto a photosensitive element, each of the unfixed toner images corresponding to a high density image;

detecting the unfixed toner images by a photoelectric sensor which detects toner adhering amounts of the unfixed toner images; and correcting each of outputs of said toner density sensors within said entire developing means in response to detected results of said photoelectric sensor where a color-balance with respect to the three colors is unbalanced upon detecting of said photoelectric sensor;

all outputs of said toner density sensors with respect to the three colors being corrected in response to a detected result of a reference color where all toner adhering amounts with respect to the three colors are within a predetermined allowable range upon detecting of said photoelectric sensor.

2. A color-balance control method according to claim 1 in which a toner adhering amount with respect to the reference color is a middle value among the toner adhering amounts detected with respect to the three colors.

3. A color-balance control method according to claim 1 in which all outputs of said toner density sensors with respect to the three colors are corrected in response to a detecting result of a color having a toner adhering amount most exceeding the predetermined allowable range in a case where a toner adhering amount with respect to at least one color among the three colors exceeds the predetermined allowable range upon detecting of said photoelectric sensor.

* * * * *